United States Patent [19]

Godino et al.

[11] Patent Number: 4,621,724

[45] Date of Patent: Nov. 11, 1986

[54] FRACTIONATOR HAVING REDUCED PRODUCT VAPOR CONDENSATION IN THE FLASH ZONE

[75] Inventors: Rino L. Godino, Livingston, N.J.; Robert R. DeBiase, Staten Island, N.Y.

[73] Assignee: Foster Wheeler Energy Corporation, Livingston, N.J.

[21] Appl. No.: 650,157

[22] Filed: Sep. 13, 1984

[51] Int. Cl.[4] ..... B01D 3/06

[52] U.S. Cl. ..... 196/139; 196/102; 202/153

[58] Field of Search ..... 208/131, 106; 196/100, 196/98, 102, 115, 139, 114; 202/153

[56] References Cited

U.S. PATENT DOCUMENTS

| | | | |
|---|---|---|---|
| 1,530,325 | 3/1925 | Price . | |
| 2,040,431 | 5/1936 | Dean et al. | 196/114 |
| 2,071,643 | 2/1937 | Maher | 196/100 |
| 2,073,446 | 3/1937 | Ellsberg | 196/139 |
| 2,078,899 | 4/1937 | Sydnor | 208/131 |
| 2,713,023 | 7/1955 | Irvine . | |
| 2,725,343 | 11/1955 | Lambert | 196/114 |
| 3,110,663 | 11/1963 | Miller . | |
| 3,136,706 | 6/1964 | Harper . | |
| 3,309,295 | 3/1967 | Cahn . | |
| 3,492,795 | 2/1970 | Guerrieri | 196/139 |
| 3,617,515 | 11/1971 | Bloomer | 208/131 |

FOREIGN PATENT DOCUMENTS

| | | | |
|---|---|---|---|
| 459134 | 8/1949 | Canada | 208/131 |

*Primary Examiner*—Peter Kratz

*Attorney, Agent, or Firm*—Marvin A. Naigur; John E. Wilson; John P. Shannon, Jr.

[57] ABSTRACT

A fractionator for yielding petroleum products in association with a delayed coking process includes a bottom having a pool of petroleum residue and recycle liquid, a flash zone above the pool, an inlet line for conveying to the flash zone product vapors which are relatively warm with respect to the pool, and a baffle positioned between the flash zone and the pool to isolate the relatively warm product vapors from the pool and, thereby, reduce condensation of the product vapors. The fractionator also includes a wash zone, above the flash zone, in which the product vapors condense, and a downwardly pointed frustoconical element, an annular trough and an arrangement of conduits for conducting the condensed recycle liquid from the wash zone to the pool, out of contact with the product vapors in the flash zone.

3 Claims, 1 Drawing Figure

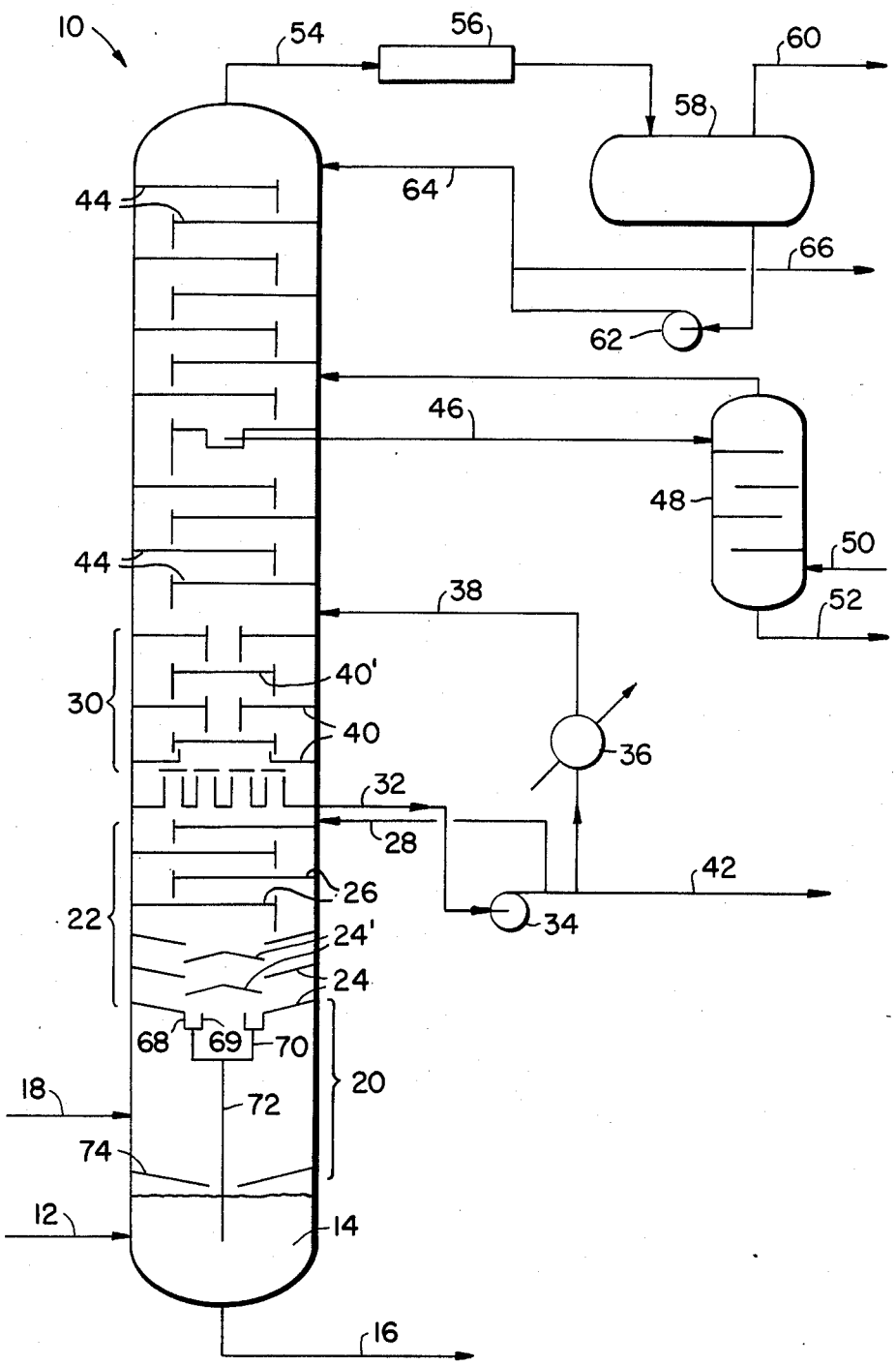
10
54
56
60
58
64
44
66
62
46
48
50
44
38
52
40'
30
40
36
32
28
42
26
22
34
24'
24
68
69
70
20
18
72
74
12
14
16

FRACTIONATOR HAVING REDUCED PRODUCT VAPOR CONDENSATION IN THE FLASH ZONE

BACKGROUND OF THE INVENTION

The present invention relates in general to a delayed coking process, and more particularly, to an apparatus and method for maximizing the yield of petroleum products in a delayed coking process.

Essentially, delayed coking is a thermal process whereby reduced crude, or petroleum residue, is rapidly heated in a coker furnace and then confined in one of a pair of reaction zones, or coke drums, under proper conditions of temperature and pressure until the portion of the crude not vaporized in the furnace is converted to vapor and coke. In the coking process, before the reduced crude is rapidly heated and directed to the coke drum, it is preheated and fed into a coker fractionating tower, or fractionator, which is in fluid communication with the coke drum. The petroleum residue is fed into a lower, surge zone at the bottom of the fractionator, where it mixes with recycle liquid, which is condensed from product vapors in the fractionator, to define a pool of liquid at the bottom of the fractionator. The mixture of petroleum residue and recycle liquid is fed to the coker furnace, where its temperature is raised to the level necessary for coke formation in the coke drums. The heated mixture is pumped to one of the coke drums, where it is converted to coke and light hydrocarbon product vapors. The product vapors pass upward through the coke drum, leave overhead and flow back to the fractionator, where they enter in a flash zone, which is above the surge zone containing the mixture of petroleum residue and recycle liquid. The product vapors are quenched and washed as they rise through a wash zone in a tortuous path defined by a series of baffles and wash trays contacted with pumped-back hot gas oil. The washing operation just described cleans and cools the product vapors and simultaneously condenses a portion of the product vapors into the liquid recycle which falls to the bottom of the fractionator. The remaining product vapors continue to rise into the upper portions of the fractionator, where they are taken off as heavy gas oil, light gas oil, gasoline and gas.

It would be ideal for all of the product vapors to pass undiminished through the wash zone and be taken off as product, but condensation of some of the product vapors into the liquid recycle is an inherent characteristic of the washing operation. In addition, as the condensed recycle falls from the wash zone and through the flash zone, it comes into direct contact with the rising product vapors. As a result, an additional portion of the product vapors condenses before the vapors reach the wash zone. Furthermore, the pool of petroleum residue and recycle liquid is relatively cool with respect to product vapors in the flash zone, which is just above the pool. Therefore, the coolness of the pool causes a portion of the vapors in the flash zone to condense and fall into the pool. Moreover, as the newly condensed recycle liquid falls into the pool, it causes liquid to splash up into contact with the product vapors in the flash zone, resulting in still further condensation of the vapors. Therefore, the product vapor flow through the fractionator is reduced and the product yield of the fractionator is reduced. In addition, greater amounts of recycle liquid are formed and must be reheated in the coker furnace.

SUMMARY OF THE INVENTION

Therefore, in order to overcome the drawbacks of the prior art, it is an object of the present invention to provide an apparatus and process which increases the product yield of the fractionator.

More specifically, it is an object of the present invention to reduce the condensation of the rising product vapors in the flash zone.

In order to achieve these and other objects, the apparatus according to the present invention includes a trough for collecting the condensed recycle liquid at the bottom of the wash zone and an arrangement of conduits for conveying the recycle liquid, out of contact with the product vapors in the flash zone, from the wash zone to the pool recycle liquid and petroleum residue in the bottom of the fractionator. A passage is defined adjacent to the trough to allow the product vapors rising from the flash zone to pass into the wash zone. At least one of the conduits extends into the pool to prevent splashing of the liquid as the newly condensed recycle liquid enters it. A splash baffle is provided just above the pool to separate the product vapors in the flash zone from the cooling influence of the relatively cool pool of recycle liquid and petroleum residue. The splash baffle includes an opening to allow the conduit to pass into the pool and to allow any incidental condensed recycle liquid from the flash zone to drain into the pool.

BRIEF DESCRIPTION OF THE DRAWING FIGURE

The FIGURE is a schematic illustration of a fractionator employing the apparatus and process according to the present invention.

DETAILED DESCRIPTION OF THE PREFERRED EMBODIMENT

In the FIGURE, a fractionating tower, or fractionator, employing the apparatus and process according to the present invention is designated generally by the reference numeral 10. Petroleum residue, which is typically preheated, is fed through a petroleum residue inlet line 12 into the fractionator 10 to a surge zone near the bottom. The petroleum residue mixes with condensed recycle liquid to form a pool 14 of a blend or mixture at the bottom of the fractionator 10. The mixture is drawn off through a coker furnace feed line 16 at the bottom of the fractionator 10 and fed to a coker furnace (not shown) until its temperature is raised to a level suitable for forming coke. The mixture is then fed to coke drums (not shown) in which the coke forms and light hydrocarbon vapors called coke drum vapors, or product vapors, pass to the top. The product vapors leave the coke drums overhead and flow into the fractionator 10 through a product vapor inlet line 18, which enters the fractionator 10 in a flash zone 20 between a wash zone 22 and the pool 14 of the mixture of petroleum residue and recycle liquid. The temperature of the product vapors is such that the product vapors rise through the fractionator 10.

The wash zone 22 includes a plurality of baffles 24 and 24' and a plurality of wash trays 26, all of which define a tortuous path for the rising product vapors. The wash trays 26 are contacted with pumped-back wash oil, essentially heavy gas oil, which is pumped into the wash trays 26 through a wash oil inlet line 28. The product vapors are quenched and washed in a washing process as they rise through the baffles 24, 24' and the wash trays 26, whereby they are cooled so that a portion of them condenses into recycle liquid.

The product vapors which remain after the washing process rise into upper zones of the fractionator 10 where they are taken off as heavy gas oil, light gas oil, gasoline and gas. Immediately above the wash zone 22 is a heavy gas oil condensing zone 30 from which heavy gas oil is drawn off through a heavy gas oil outlet line 32 and pumped off by a pump 34. A portion of heavy gas oil from the line 32 is pumped back to the wash trays 26 through the wash oil inlet line 28. Another portion of the heavy oil is pumped through a cooler 36 and a pumparound inlet line 38 to fill condensing trays 40 and 40' in the heavy gas oil condensing zone 30. The remainder of the heavy gas oil is pumped off through a line 42 as product. Above the heavy gas oil condensing zone 30 is a zone containing a series of fractionating trays 44, one of which feeds a light gas oil outlet line 46. The outlet line 46 is connected to a stripper 48 to which steam is fed by an inlet line 50. The light gas oil product is taken from the stripper 48 through a line 52. The product vapors which remain in the fractionator 10 above the fractionating trays 44 flow overhead through an outlet line 54 to a condenser 56, where they are partially condensed, and then to an accumulator 58. A portion of product vapors in the accumulator 58 are taken off through an outlet line 60 as gas product. A portion of the condensed liquid in the accumulator 58 is pumped by a pump 62 back into the fractionator 10 through a line 64 as pumpback reflux. The rest of the liquid from the accumulator 58 is pumped through a line 66 as gasoline product.

The recycle liquid which condenses in the wash zone 22 falls to the bottom baffle of the baffles 24, which, in the embodiment shown in the FIGURE, are downwardly-pointing frustoconical plates attached to the inner surface of the cylindrical wall of the fractionator 10. The bottom baffle is a part of a structure for conducting the newly condensed recycle liquid from the wash zone 22, out of contact with the product vapors in the flash zone 20, to the pool 14. The structure also includes an annular trough 68 which is secured to the bottom baffle in a central opening which the bottom baffle defines. The annular trough 68 also defines a central opening 69 through which the product vapors can rise from the flash zone 20 to the wash zone 22. A plurality of conduits 70 each have one end connected to the bottom of the trough 68 and another end connected to a main conduit or standpipe 72 which extends down through the flash zone 20 into the pool 14 of the mixture of petroleum residue and recycle liquid, below the surface of the liquid. Thus, recycle liquid which condenses in the wash zone 22 falls onto the bottom baffle and flows into the annular trough 68 and through the conduits 70 and standpipe 72 into the pool 14 without contacting the product vapors in the flash zone 20 and without splashing the liquid in the pool 14. Therefore, the falling recycle liquid is prevented from contacting product vapors rising in the flash zone 20 and, thereby, causing them to condense.

As an additional measure against condensation in the flash zone 20, a splash baffle 74, which is in the form of a downwardly-pointing frustoconical plate, is secured to the inner surface of the cylindrical wall of the fractionator 10 just above the level of the mixture in the pool 14. Thus, the splash baffle 74 defines a thermal barrier isolating the relatively warm product vapors in the flash zone 20 from the relatively cool pool 14 of the liquid and, thereby, further reducing condensation of the product vapors. Furthermore, any incidental recycle liquid which might condense on the conduits 70 or on the undersides of the bottom baffle 24 or the annular trough 68 will be prevented by the splash baffle 74 from falling directly into the pool 14 and, thereby, splashing the mixture up into the flash zone 20 and into contact with the product vapors. The splash baffle 74 includes a central opening through which the standpipe 72 passes in order to extend into the pool 14.

It is understood that elements such as the trough, conduits, standpipe and splash baffle can take other forms and that various other modifications, changes and substitutions are intended in the foregoing disclosure and that some features of the invention can be employed without a corresponding use of other features. Accordingly, it is appropriate that the appended claims be construed broadly and in a manner consistent with the spirit and scope of the invention.

We claim:

1. Apparatus for producing petroleum products in a coking process comprising:

a fractionator having a bottom;

a pool of petroleum residue and recycle liquid in the bottom of said fractionator;

a flash zone defined in said fractionator above said pool;

means for conveying petroleum residue to said pool in the fractionator bottom;

means for conveying from a coke drum product vapors into said flash zone, wherein condensation of the product vapor tends to occur, the product vapors being relatively warm with respect to said pool; and means for reducing the condensation of the product vapors in said flash zone, said condensation reducing means including barrier means for isolating the relatively warm product vapors in said flash zone from said pool, wherein the barrier means comprises a baffle positioned between the flash zone and the pool, said baffle being a downwardly pointing imperforate frustoconical element arranged across the entire cross-section of said fractionator except for a central opening therein.

2. Apparatus for producing petroleum products in a coking process comprising:

a fractionator having a bottom;

a pool of petroleum residue and recycle liquid in the bottom of said fractionator;

a flash zone defined in said fractionator above said pool;

means for conveying petroleum residue to said pool in the fractionator bottom;

means for conveying from a coke drum product vapors into said flash zone, wherein condensation of the product vapors tends to occur, the product vapors being relatively warm with respect to said pool;

means for reducing the condensation of the product vapors in said flash zone, said condensation reducing means including barrier means extending across substantially the entire cross-section of said fractionator for isolating the relatively warm product vapors in said flash zone from said pool;

a second zone in said fractionator, above said flash zone, in which the product vapors condense into recycle liquid; and means for conducting the condensed recycle liquid, out of contact with the product vapors in said flash zone, from said second zone into said pool below the surface of the pool, wherein the conducting means comprises a baffle secured in said fractionator at the bottom of said second zone, said baffle being a downwardly pointing frustoconical element having a central opening, and the conducting means further comprises an annular trough secured to said baffle in said central opening at the periphery thereof, and a conduit located entirely within said fractionator and connected to said trough, said conduit extending to a location below the surface of said pool.

3. Apparatus for producing petroleum products in a coking process comprising:

a fractionator having a bottom;

a pool of petroleum residue and recycle liquid in the bottom of said fractionator;

a flash zone defined in said fractionator above said pool;

means for conveying petroleum residue to said pool in the fractionator bottom;

means for conveying from a coke drum product vapors into said flash zone, wherein condensation of the product vapors tends to occur, the product vapors being relatively warm with respect to said pool;

means for reducing the condensation of the product vapors in said flash zone, said condensation reducing means including barrier means extending across substantially the entire cross-section of said fractionator for isolating the relatively warm product vapors in said flash zone from said pool;

a second zone in said fractionator, above said flash zone, in which the product vapors condense into recycle liquid; and means for conducting the condensed recycle liquid, out of contact with the product vapors in said flash zone, from said second zone into said pool, said conducting means being located entirely within said fractionator, and wherein said barrier means comprises a baffle having a central opening, and said conducting means includes a conduit extending through said central opening.

* * * * *